US006088895A

United States Patent [19]

Nelson et al.

[11] Patent Number: 6,088,895

[45] Date of Patent: Jul. 18, 2000

[54] METHOD FOR DESCALING HOT ROLLED STRIP

[75] Inventors: Christian D. Nelson, Middletown; Christopher M. Kovscek, Lebanon; Jerald W. Leeker, Trenton, all of Ohio

[73] Assignee: Armco Inc., Middletown, Ohio

[21] Appl. No.: 09/234,816

[22] Filed: Jan. 21, 1999

[51] Int. Cl.[7] ..... B21B 45/04

[52] U.S. Cl. ..... 29/81.01; 29/81.03; 29/527.6; 72/40

[58] Field of Search ..... 29/81.03, 81.01, 29/81.12, 81.13, 527.6, 527.7; 72/40

[56] References Cited

U.S. PATENT DOCUMENTS

| | | | |
|---|---|---|---|
| 3,991,462 | 11/1976 | Engel | 29/605 |
| 4,872,245 | 10/1989 | Kawasaki et al. | 29/81 A |
| 5,003,804 | 4/1991 | Kenmochi | 72/39 |
| 5,131,126 | 7/1992 | Katsuki et al. | 29/81.06 |
| 5,197,179 | 3/1993 | Sendzimir | 29/527.4 |
| 5,495,736 | 3/1996 | Nishi | 72/39 |
| 5,554,235 | 9/1996 | Noe et al. | 148/610 |
| 5,606,787 | 3/1997 | McGuire | 29/81.03 |
| 5,820,704 | 10/1998 | Veyer et al. . | |
| 5,948,181 | 9/1999 | Kohno | 148/325 |

FOREIGN PATENT DOCUMENTS

| | | | |
|---|---|---|---|
| 0387786 | 3/1990 | European Pat. Off. . | |
| 133802 | of 1980 | Japan | B21B 1/28 |
| 51729 | of 1995 | Japan | B21B 45/06 |

*Primary Examiner*—Irene Cuda
*Assistant Examiner*—Anthony L. Green
*Attorney, Agent, or Firm*—K. L. Davidson; L. A. Fillnow

[57] ABSTRACT

This invention relates to a process for producing a cold rolled, recrystallation annealed, stainless steel strip having lustrous surfaces without being hot band annealed and/or pickled prior to cold reduction. The process includes the sequential steps of tension leveling to crack the scale and flatten a hot processed metal strip, shot blasting the strip to ablatively remove the scale and to provide a surface roughness less than 3.6 micron Ra using at least two pairs of wire brushes positioned adjacent to both surfaces of the strip with these cleaning brushes being rotated in opposite directions relative to each other to mechanically remove any residual scale. The mechanically cleaned strip then is mechanically polished with another pair of brushes to reduce the roughness to less than 2.0 micron Ra, cold reduced to have a surface roughness less than 0.4 micron Ra and recrystallization annealed. The particulate shot has a size of 0.10–0.50 mm. The cleaning brushes have a surface density of at least 12% unit square surface area and the bristles of the cleaning brushes have a tip diameter of 0.13–0.50 mm.

26 Claims, 1 Drawing Sheet

METHOD FOR DESCALING HOT ROLLED STRIP

BACKGROUND OF THE INVENTION

This invention relates to a process for producing cold rolled metal strip without hot band annealing and/or pickling of a hot processed strip prior to cold reduction. The process includes the sequential steps of tension leveling to crack scale and to flatten the hot processed metal strip, particle blasting the strip to ablatively remove the scale, positioning at least two cleaning brushes adjacent each surface of the strip and rotating the brushes in opposite directions relative to each other to remove any residual scale and to provide a predetermined roughness, polishing the cleaned surfaces with a brush to further reduce the roughness and cold reducing the cleaned strip so that the surfaces have a lustrous finish.

It is known to flatten hot rolled strip prior to cold reduction using a leveler. U.S. Pat. No. 4,872,245 discloses a process line for producing cold rolled steel strip from hot rolled strip. This patent discloses a hot rolled strip being elongated not more than 7% using a tension leveler having bridle and bending rollers to flatten the strip and to transversely crack scale. The elongated strip then is descaled by being passed through a pair of brushes and a pickle tank prior to cold reduction on a tandem mill.

It is known to cold reduce a hot rolled metal strip without recrystallization annealing and/or pickling of the hot rolled strip prior to cold reduction. U.S. Pat. No. 5,197,179 discloses a continuous process line for producing cold rolled stainless steel from hot rolled strip. This patent discloses a hot rolled strip being passed through a cold reduction tandem or reversing mill prior to annealing and pickling. Shot blasting may be used to help remove the scale.

It also is known to descale hot rolled metal strip without recrystallization annealing and/or pickling of the hot rolled strip prior to cold reduction. These descaling processes include one or more of the steps of tension leveling to crack the scale and flatten the hot rolled metal strip, grit blasting of the strip to remove the scale and mechanical brushing of the hot rolled strip prior to cold reduction. U.S. Pat. No. 5,606,787 discloses a continuous process line for producing cold rolled stainless steel from hot rolled strip. This patent discloses a hot rolled strip being passed through a tandem cold mill, a continuous annealing furnace, an optional molten salt bath, a pickler and an optional temper mill. Shot blasting and annealing of the strip prior to cold reduction is not required to produce a surface roughness less than 80 $\mu$-inch after a single cold rolling. U.S. Pat. 5,554,235 discloses a continuous process line for producing cold rolled stainless steel without annealing or acid pickling a hot rolled strip prior to cold rolling on a tandem mill. This patent discloses a hot rolled strip being descaled by optionally stretching in a leveler to flatten the strip and to crack the scale and then using a shot blaster or a brush polisher to remove the scale prior to cold reduction. After cold rolling, the strip optionally may be passed through a conventional annealing furnace, another shot blaster, a brush polisher, a pickier and stretch levelers. Japanese patent application 55-133802 discloses a process line for producing cold rolled steel from hot rolled strip without annealing or acid pickling the hot rolled steel prior to cold rolling. The hot rolled strip is descaled using a tension leveler to crack the scale, passed through high pressure water sprays and finally through brushing rolls prior to passing through a cold rolling tandem mill.

Nevertheless, cold reduced steel surface flatness and roughness requirements are becoming increasingly more stringent for applications such as stainless steel sheet and tubing for fabrication into sinks, appliances, automotive trim, and the like. These applications often require cold reduced strip having no more than 20 I-units of flatness across the strip width and a surface roughness less than 0.4 micron Ra. The prior art processes for producing a cold rolled strip without hot band annealing and/or pickling prior to cold reduction do not produce the necessary flatness and surface smoothness to meet these customer requirements after cold reduction. Accordingly, there remains a need for an improved process for producing cold rolled metal strip, especially stainless steel, having lustrous surfaces without hot band annealing and/or pickling of a hot processed strip prior to cold reduction. There also remains a need for a process for descaling hot processed ferrous metal strip prior to cold reduction that does not require hydrochloric or sulfuric acid pickling. There also remains a need for a process for descaling hot processed stainless steel strip that does not require nitric acid, hydrofluoric acid or a fluoride compound.

BRIEF SUMMARY OF THE INVENTION

This invention relates to a process for producing cold rolled metal strip having lustrous surfaces without hot band annealing and/or pickling of a hot processed strip prior to cold reduction.

A principal object of the invention is to provide a metal strip cold reduced to final gauge without having to anneal or pickle a hot processed strip prior to the cold reduction.

Another object of the invention is to provide this cold reduced metal strip having lustrous surfaces having a roughness less than 0.4 micron Ra while meeting standard thickness and gauge tolerances.

Another object of the invention is to provide this cold reduced metal strip having no more than 20 I-units of flatness across the strip width.

Additional objects of the invention include providing a descaling process that eliminates or minimizes the formation of pickling solution by-products, especially nitric or hydrofluoric acids or fluoride compounds, that would cause an environmental disposal problem and providing a cost advantage compared to steel sheet otherwise produced by being annealed and pickled prior to cold reduction.

The invention includes the sequential steps of tension leveling a hot processed metal strip to crack scale and to flatten the strip, particle blasting the surfaces of the strip to ablatively remove the scale, positioning at least two cleaning brushes both adjacent to each strip surface and rotating the brushes in a direction opposite to one another to remove any residual scale and to provide a predetermined roughness to each strip surface, polishing each cleaned strip surface with a brush to further reduce the roughness and cold reducing the cleaned strip so that the surfaces have a lustrous finish.

Another feature of the invention is for the aforesaid strip to be stretched in tension at least 1% elongation.

Another feature of the invention is for the aforesaid polished surfaces to have a roughness less than 1.5 micron Ra prior to cold reduction.

Another feature of the invention is for the aforesaid cleaning brushes to have a surface density greater than 12% unit square surface area.

Another feature of the invention is for the aforesaid cleaning brushes having bristles of a diameter of 0.13–0.50 mm.

Another feature of the invention is for the aforesaid cold reduced strip having a roughness less than 0.4 micron Ra.

Another feature of the invention is for the aforesaid strip being cold reduced at least 30%.

Another feature of the invention is to include at least three of the aforesaid cleaning brushes adjacent to each strip surface.

Another feature of the invention is for at least 90% of the aforesaid particles having a size of 0.10–0.50 mm.

Advantages of the invention include reduction in manufacturing cost, minimization of formation of pickling solution by-products, especially nitric or hydrofluoric acids or fluoride compounds, that would cause an environmental disposal problem and recycling scale 'dust' back to a melting refining furnace. The process of the invention obviates the need for expensive pollution control and waste treatment facilities.

The above and other objects, features and advantages of the invention will become apparent upon consideration of the detailed description and appended drawings.

DETAILED DESCRIPTION OF THE PREFERRED EMBODIMENT

Figure 1:
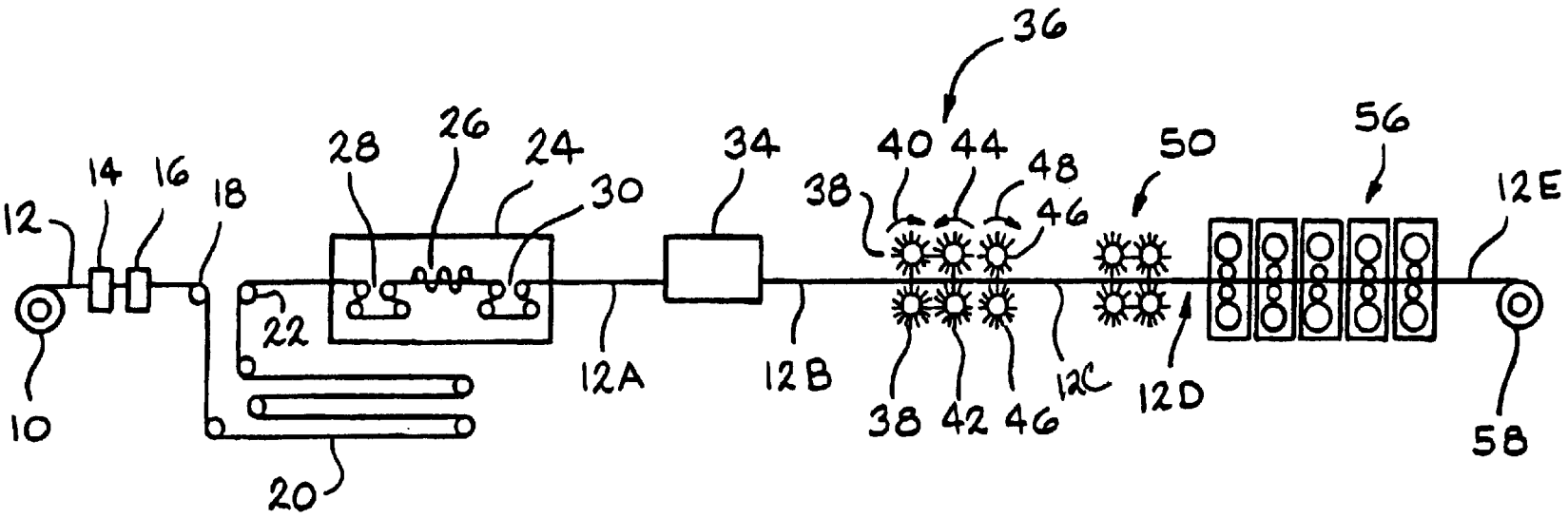
FIG. 1 illustrates a schematic view of a continuous processing line of the invention for producing a cold rolled metal strip from a hot processed strip including the sequential steps of tension leveling the hot processed strip, shot blast cleaning the strip, brush cleaning the strip, brush polishing the strip and cold reducing the strip.

A metal strip of the invention may be produced from a melt, especially a chromium containing steel melt, by being continuously cast into a strip having a thickness of ≦10 mm, a thin slab ≦140 mm, a thick slab ≦200 mm or cast into an ingot. The cast metal then is hot processed into a continuous length strip. By "hot processed" will be understood the metal strip will be reheated, if necessary, and then reduced to a predetermined thickness such as by hot rolling. If hot rolled, a steel slab may be reheated to 1050–1300° C., hot rolled using a finishing temperature of at least 800° C. and coiled at a temperature no greater than about 650° C. Additionally, the hot rolled strip will be descaled and cold reduced preferably at least 30%, more preferably at least 50%, to the desired final gauge thickness. Thereafter, the cold reduced strip may be recrystallization annealed. A significant advantage of this invention is a hot processed strip is not required to be annealed prior to cold reduction, i.e., a hot band anneal. Another equally significant advantage of this invention is a hot processed strip is not required to be chemically treated, i.e., pickled, to remove scale prior to this cold reduction.

The metal strip of the present invention can be produced from a hot processed strip made by a number of methods from different metals. The strip can be produced from slabs formed from ingots or continuous cast slabs which are reheated followed by hot rolling to provide a starting hot processed strip of 2–6 mm thickness or the strip can be hot processed from strip continuously cast into thicknesses of 2–10 mm. The present invention also is applicable to strip produced by methods wherein continuous cast slabs or slabs produced from ingots are fed directly to a hot mill with or without significant heating, or ingots hot reduced into slabs of sufficient temperature to hot roll to strip with or without further heating, or the molten metal is cast directly into a strip suitable for further processing. The metals of the invention may include but are not limited to ferrous metals such as low carbon steel, chromium alloyed steel, ferritic stainless steel, austenitic stainless steel, martensitic stainless steel and non-ferrous metals such as titanium, copper and nickel.

An important feature of this invention is to elongate, in tension, a hot processed strip sufficiently, preferably at least about 1%, more preferably 2–10%, most preferably 2–7%, to loosen or crack brittle scale on both surfaces of the strip and to flatten the strip, if necessary. As will be discussed below, the cracked scale will be ablatively removed by particle blasting followed by brushing and polishing. Means for applying tension to the strip to eliminate buckles thereby forming a "dead flat" strip may include a temper mill or preferably a tension leveler including multiple bending and bridle rollers. It is important to elongate the strip at least 1% because many applications for stainless steel sheets often require the sheet to have less than 40 I-units, preferably no more than about 20 I-units, of flatness across the sheet width. An I-unit of flatness is the relationship between the height and wavelength of a sheet buckle and is defined by the relationship $I=(L1-L2)/L)\times10^5$ where L1=the longest ribbon across the width of the strip, L2=the shortest ribbon across the width of the strip, and L=wavelength.

A very important feature of this invention is to remove cracked scale from the hot processed strip by blasting with abrasive particles, i.e., grit having angular or serrated surfaces or preferably spherical shot. Particle blasting of scaled strip surfaces is used in the invention because considerable blast cleaning, in addition to cracking caused by stretching, is required to insure removal of the hot mill scale, especially ferritic and austenitic stainless steel scales which are difficult to remove. Suitable particles of this invention may be ferrous spherical shot or serrated grit with at least 95% of the particles having a diameter at least 0.10 mm. Preferably, at least 45% of the particles will have a diameter of 0.30–0.50 mm. More preferably, at least 90% of the particles will have a diameter of 0.10–0.50 mm. Most preferably, 45–55% of the particles will have a diameter of 0.10–0.30 mm, 45–55% of the particles will have a diameter greater than 0.30 mm up to 0.50 mm and no more than 10% of the particles will have a diameter greater than 0.50 mm. It is important that at least 95% of the abrasive particles have a diameter of at least 0.10 mm to provide adequate impact energy and a good dispersion of particles, i.e., uniform number of particulate impacts per unit time, across the width of the strip to provide satisfactory cleaning. It also is important that an assay of an abrasive sample has no more than about 10% of the particles having a diameter greater than 0.50 because excessive energy impact results in average surface roughness (Ra) greater than that otherwise being able to be removed in subsequent processing. Non-metallic particles such as glass, silica, alumina, and the like, are not acceptable for an abrasive of this invention because they do not provide adequate cleaning of the strip surface. Unlike prior art shot blasting cleaning systems having inadequate particle throughput where the particles are transported to a steel surface pneumatically, i.e., compressed gas, the metal particles of the invention preferably are transported to a steel surface using a high speed rotating wheel. The velocity of the metal particles should be at least 55 m/sec. Using a high speed wheel to fling the metal particles to the strip surface is advantageous because using a speed at least about 55 m/sec for the particle sizes described above provides ample impact energy to remove the most adherent of stainless steel hot mill scales.

A further very important feature of this invention is to remove any remaining residual cracked scale from the hot processed strip using at least two cleaning brushes, preferably wire brushes, positioned adjacent to each surface being cleaned with the brushes being rotated in opposite directions relative to one another. The reason at least one pair of oppositely rotating brushes is required for each strip surface is to insure total coverage of the strip surface with brushing to fully descale the entire surface, including the craters left behind by the metal particle blasting of the strip surfaces. Each pair of brushes should reduce roughness of each of the cleaned but unpolished strip surfaces to preferably less than 3.6 micron Ra ($\mu$m or micrometer), more preferably to no more than 3.0 micron Ra and most preferably to no more than 2.5 micron Ra at this stage of the processing. We have determined the bristles of these cleaning brushes should have a small tip diameter of 0.13–0.50 mm. Not being bound by theory, it is believed the tip diameter should be at least 0.13 mm because smaller diameter wire bristles apparently have insufficient rigidity to physically penetrate into the small craters formed on the strip surfaces by the shot blasting particles to remove scale therefrom. If the tip diameter exceeds about 0.50 mm, then the wire bristles apparently are too large to penetrate into the small craters. This leaves scale within the craters and therefore, when the strip is cold reduced, scale is rolled or imbedded into the strip surfaces resulting in an unexceptable final surface finish. Preferably, the tip diameter of the bristles should be 0.13–0.25 mm. Since the bristles of the oppositely rotating cleaning brushes of the invention have a tip diameter of as small as 0.13 mm, it also is important the brushes have sufficient surface density, i.e., bristles being sufficiently tightly packed, so that the bristles penetrate into the small craters formed on the strip surface by shot blasting. We have determined a preferred minimum surface density of the brushes is at least 12% unit square surface area, or simply 12% and more preferably at least 20%. Unit square surface area is defined as units$^2$ of bristles surface area per surface area of the strip, e.g., 0.12 cm$^2$ of bristles/1 cm$^2$ of surface area of strip and 0.20 cm$^2$ of bristles/1 cm$^2$ surface area of strip are 12% and 20% respectively.

Wire brushes are the cleaning brushes of choice because metal removal from the strip surfaces does not occur as is the case when brushes made from synthetic bristles are used. Synthetic brushes can be woven, matted or of a bristle design having a carbide impregnated synthetic material, e.g., nylon, with differing amounts and sizes of abrasive material. Brushes made using these synthetic bristles and impregnated with materials such silicon carbide or aluminum oxide are unacceptable for the oppositely rotating cleaning brushes of this invention. Brushes made using synthetic bristles are undesirable because as much as 2% yield loss can occur to the strip because of metal ground from the surfaces. Wire brushes, on the other hand, are less likely to grind or scour the strip surface. A preferred wire brush for use with the invention is available from Maryland Brush Company, Baltimore, Md. This brush is constructed by mounting wire bristles onto a metal crimp and wrapping this crimp around a barrel by helical winding. Preferably, the surface of the brush has a bristle density of at least 12% unit square surface area. If the density is less then 12%, the coverage of bristle tips onto strip surface area may not be adequate to completely remove all scale. Unlike the prior art, it is critical that these cleaning brushes be rotated in opposite directions relative to one another. The reason for this requirement is because the brush bristle tips have been demonstrated to completely remove scale from surface depressed areas, e.g., pits, craters, of the strip. Preferably, there are at least three of these cleaning brushes mounted adjacent to each strip surface. If there are three cleaning brushes, the first brush preferably will be rotated in a direction opposite the direction of travel of the metal strip. If the first brush is rotated clockwise while the strip is traveling from left to right, the second brush then would be rotated counter clockwise, the third brush would be rotated clockwise, and so forth.

A final important feature of this invention is the hot processed clean strip be additionally treated by a polishing brush to reduce the roughness prior to cold reduction to less than 2.0 micron Ra, preferably to no more than 1.5 micron Ra and most preferably to no more than 1.0 micron Ra, to produce a "white" or "matte" surface finish. This final polishing brush can have synthetic bristles, although a brush with wire bristles again is preferred. For some stainless steel applications, it is necessary to have a surface roughness of less than 0.4 micron Ra, preferably less than 0.3 micron Ra, after cold reduction. To insure this type of lustrous surface finish, the roughness should not exceed 1.5 micron Ra ahead of the cold reduction mill.

To better understand the invention, FIG. 1 illustrates a schematic view of a continuous processing line for producing a cold rolled metal strip from a hot processed strip. It will be understood the processing also could use separate processing units as well. The processing line includes the sequential steps of unwinding a hot processed strip 12 from a payoff reel 10. The ends of the strip may be squared by a shear 14 and welded for continuous processing by a welder 16. The continuous strip then passes through a looper 20 including an entry bridle roller 18 and an exit bridle roller 22. Thereafter, the strip is elongated in tension by a stretch leveler 24 including bridle rollers 28, 30 and bending rollers 26. This stretching and bending flattens the strip to a 'dead flat' condition as well as cracks and loosens the scale. Stretched strip 12A then passes through a shot blaster 34 wherein most of the scale is ablatively removed from the strip. The partially cleaned surfaces of strip 12B then are passed through a brush cleaning station 36 including multiple pairs of cleaning brushes 38, 42, 46 for mechanically removing any residual scale and for reducing the surface roughness of the strip. These cleaning brushes will include at least two pairs of brushes 38, 42 and preferably at least a third pair of brushes 46 juxtaposed on opposite sides of the strip, i.e., one above and one below the strip. It is important each cleaning brush be rotated in a direction opposite to that of its adjacent brush, i.e., positioned on the same side of the strip. For example, at brush cleaning station 36, upper brush 38 would be rotated clockwise, upper brush 42 is rotated counterclockwise and upper brush 46 is rotated clockwise as indicated by arrows 40, 44, 48 respectively. The lower cleaning brushes would be rotated exactly the opposite, i.e., lower brush 38 is rotated counterclockwise, lower brush 42 is rotated clockwise and lower brush 46 is rotated counterclockwise. Preferably, the initial pair of brushes 38 is rotated in a direction opposite to the direction of travel of strip 12B. Strip 12B is illustrated to travel from left to right. Clean strip 12C then is passed through a pair of juxtaposed polishing brushes 50, one positioned above the strip and the other positioned below the strip, for reducing the roughness to less than 1.5 micron Ra, preferably to less than about 1.0 micron Ra. The processing line in FIG. 1 illustrates two pairs of polishing brushes 50. Polished strip 12D then is cold reduced preferably at least 30% in a tandem mill 56 or a Z-mill (not shown). Cold reduced strip 12E will have a surface with a lustrous finish preferably having a roughness no greater than 0.3 micron Ra. The highly polished strip 12E then may be rewound into a coil by a tension reel 58. The process illustrated in FIG. 1 may include another looper immediately ahead of tension reel 58 and additional downstream processing equipment such as a continuous annealing furnace, additional strip cleaning, e.g., acid pickier, a side trimmer, and the like, after the cold reduction mill. Reel 58 operating in concert with payoff reel 10 will stretch the metal strip in tension leveler 24. It is important to stretch the metal strip preferably at least 1% to crack the scale and to flatten the strip. Depending upon the extent of surface undulations, e.g. wavy edges, buckles, in strip 12 caused during rolling on a hot strip mill, it may be necessary to stretch the strip as much as 10% to obtain a "dead flat" strip 12A.

EXAMPLE 1

In a comparative example, a stainless steel slab having a thickness of 20 cm was hot rolled on a hot strip mill to produce a strip having a thickness of 2.5 mm. The strip was passed through a tension leveler where the strip was stretched 3.5% to crack the scale and flatten the strip to a dead flat condition. The stretched strip then was passed through a shot blasting machine to clean both surfaces of the strip. Thereafter, the shot blasted strip was brushed with synthetic bristle brushes impregnated with aluminum oxide brushes mounted on both sides of the strip with the brushes being rotated in the same direction at speeds of 1000–3000 rpm. Various amounts of visible salt and pepper scale remained on both surfaces of the strip. This pepper scale demonstrated that the hot mill scale was not satisfactorily removed from the strip. The thickness of the strip after cleaning was reduced 0.05 mm due to excessive grinding by the synthetic brushes removing metal thickness from the surfaces. This excessive grinding caused a yield loss of about 2%. Thereafter, the strip was passed between four sets of polishing brushes mounted on both sides of the strip with the brushes being rotated at speeds of 1000–3000 rpm and in a direction counter to the strip travel direction. The surface roughness of the strip was 3.6 micron Ra. The strip then was cold reduced 40% on two Z-high cold reduction mills operated in tandem. The work rolls had a surface roughness less than 1.3 micron Ra. After cold reduction, the final cold reduced stainless strip had a surface roughness of about 0.4 micron Ra, i.e., #1 finish. A desirable surface will have a roughness less than 0.4 micron Ra. A preferred 2-D finish requires a surface roughness on a final cold reduced stainless strip no greater than 0.3 micron Ra.

EXAMPLE 2

In an example illustrating the present invention, an austenitic stainless steel slab having a thickness of 20 cm was hot rolled on a hot rolling mill to produce a strip having a thickness of 2.5 mm. The strip was processed as described in Example 1 except as follows. The stretched strip then was passed through a shot blasting machine using steel particles having an assayed size of 0.29 mm. Thereafter, the shot blasted strip was cleaned with brushes available from Maryland Brush Company mounted on both sides of the strip with the brushes being rotated in opposite directions to each other. These cleaning brushes had wire bristles having a tip diameter of 0.25 mm. The density of the brushes was 21%. No visible scale remained on either surface of the strip. The thickness of the strip after cleaning was reduced less than 0.001 mm due to grinding by the wire brushes. Thereafter, the strip was passed between a pair of juxtaposed Scotch-brite® polishing brushes available from Minnesota Mining and Manufacturing of Minneapolis, Minn. A pair of these brushes were mounted on opposite sides of the strip. These brushes were rotated at speeds of 1000–3000 rpm and in a direction counter to the strip direction of travel. The surface roughness of the highly polished strip was 1.5 micron Ra. The polished strip then was cold reduced 50% on a four-high tandem cold reduction mill. The work rolls had a surface roughness of 0.13–0.30 micron Ra. After cold reduction, the final cold reduced stainless strip had a surface roughness less than 0.30 micron Ra and had a "dead flat" condition. The strip surfaces roughnesses generally were less than 0.26 micron Ra and as low as 0.13 micron Ra. This example demonstrates that the invention results in cold reduced stainless steel strip having excellent lustrous surfaces of 2-D finish, e.g., no greater than 0.3 micron Ra, by being produced from a hot rolled strip without annealing or pickling hot rolled strip prior to cold reduction. Furthermore, grinding of the strip surfaces otherwise causing a yield loss was not necessary. In this example, less than 0.01 mm of total metal surface thickness, i.e., less than 0.5%, was removed.

It will be understood various modifications may be made to the invention without departing from the spirit and scope of it. Therefore, the limits of the invention should be determined from the appended claims.

What is claimed is:

1. A method of producing cold rolled metal strip from hot processed strip without acid pickling the hot processed strip prior to cold rolling, comprising:

providing a hot processed metal strip covered with scale, stretching the strip in tension to crack the scale and to flatten the strip, particle blasting each surface of the elongated strip with particles to remove the scale and to provide a surface having a predetermined roughness, cleaning the surfaces to remove any residual scale with at least two cleaning brushes positioned adjacent to each surface and rotated in opposite directions relative to each other, polishing each cleaned surface with at least one polishing brush to further reduce the roughness, and cold reducing the strip without pickling prior to the cold reduction.

2. The method of claim 1 wherein the step of stretching the strip includes stretching the strip to an elongation of at least about 1%.

3. The method of claim 2 wherein the step of stretching the strip includes stretching the strip to an elongation of 2–7%.

4. The method of claim 1 wherein the cold reduced strip has a roughness less than 0.4 micron Ra.

5. The method of claim 4 wherein the cold reduced strip has a roughness less than 0.3 micron Ra.

6. The method of claim 1 wherein the at least two cleaning brushes includes at least three cleaning brushes adjacent each strip surface.

7. The method of claim 1 wherein the cleaning brushes have a plurality of bristles packed to a surface density greater than 12%.

8. The method of claim 7 wherein the bristles are wire and have a diameter of 0.13–0.25 mm.

9. The method of claim 1 wherein the strip has a roughness less than 2.0 micron Ra prior to cold reduction.

10. The method of claim 9 wherein the strip has a roughness no more than 1.0 micron Ra prior to cold reduction.

11. The method of claim 1 wherein at least 95% of the particles have a size of at least 0.10 mm.

12. The method of claim 1 wherein no more than 5% of the particles have a size greater than 0.50 mm.

13. The method of claim 1 wherein at least 45–55% of the particles have a size of 0.20–0.30 mm.

14. The method of claim 1 wherein the brush cleaned surfaces have a roughness less than 3.6 micron Ra.

15. The method of claim 14 wherein the cleaned surfaces have a roughness no more than 3.0 micron Ra.

16. The method of claim 1 wherein the strip is cold reduced at least 30%.

17. The method of claim 1 wherein the cold reduced strip has a flatness of no more than 20 I-units.

18. The method of claim 1 wherein the strip is stainless steel.

19. A method of producing cold rolled metal strip from hot processed metal without acid pickling the hot processed strip prior to cold rolling, comprising:

providing a hot processed steel strip covered with scale, stretching the strip in tension at least 1% to crack the scale and to flatten the strip, particle blasting the surfaces of the elongated strip to remove the scale, cleaning the surfaces to remove any residual scale with at least two cleaning brushes positioned adjacent to each surface and rotated in opposite directions relative to each other, the cleaning brushes having bristles of a diameter of 0.13–0.50 mm, polishing each cleaned surface with at least one polishing brush whereby the surfaces of the strip have a roughness less than 1.5 micron Ra, and cold reducing the strip without pickling prior to the cold reduction so that the surfaces have a roughness of less than 0.4 micron Ra.

20. A method of producing cold rolled metal strip from hot processed metal without acid pickling the hot processed strip prior to cold rolling, comprising:

providing a hot processed stainless steel strip covered with scale, stretching the strip in tension at least 1% to crack the scale and to flatten the strip, particle blasting the surfaces of the elongated strip to remove the scale, cleaning the surfaces to remove any residual scale with at least two cleaning brushes positioned adjacent to each surface and rotated in opposite directions relative to each other, the cleaning brushes having a surface density greater than 12% and having wire bristles of a diameter of 0.13–0.50 mm, polishing each cleaned surface with at least one polishing brush whereby the surfaces of the strip have a roughness no more than 1.5 micron Ra, and cold reducing the polished strip without pickling prior to the cold reduction so that the surfaces have a roughness of no more than 0.3 micron Ra.

21. The method of claim 1 wherein the at least two brushes have bristles with a tip diameter falling within the range of the diameters of the particles used in the step of particle blasting.

22. A method of removing scale from hot processed strip without acid pickling, comprising:

providing a hot processed metal strip covered with scale, stretching the strip in tension to crack the scale and to flatten the strip, particle blasting each surface of the elongated strip with particles to remove the scale and to provide a surface having a predetermined roughness, and cleaning the surfaces without acid pickling to remove any residual scale, the cleaning performed with at least two brushes positioned adjacent to each surface and rotated in opposite directions relative to each other, whereby the cleaned surfaces of the strip have a roughness less than 3.6 micron Ra.

23. The method of claim 22 wherein the cleaned surfaces have a roughness less than 2.5 micron Ra.

24. The method of claim 22 wherein the at least two brushes have bristles with a tip diameter falling within the range of the diameters of the particles used in the step of particle blasting.

25. The method of claim 22 further comprising polishing each cleaned surface with at least one polishing brush to further reduce the roughness to less than 2 micron Ra.

26. The method of claim 22 further comprising polishing each cleaned surface with at least one polishing brush to further reduce the roughness to less than 1 micron Ra.

* * * * *